US006263851B1

(12) United States Patent
Henmi

(10) Patent No.: US 6,263,851 B1
(45) **Date of Patent: *Jul. 24, 2001**

(54) AIR INLET DEVICE FOR WATERCRAFT ENGINE

(75) Inventor: Yasuhiko Henmi, Iwata (JP)

(73) Assignee: Yamaha Hatsudoki Kabushiki Kaisha (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/042,831

(22) Filed: Mar. 17, 1998

Related U.S. Application Data

(63) Continuation-in-part of application No. 09/036,765, filed on Mar. 9, 1998.

(30) Foreign Application Priority Data

Mar. 7, 1997 (JP) ..... 9-070697

(51) Int. Cl.[7] ..... F02M 35/10

(52) U.S. Cl. ..... 123/184.46; 123/184.38; 123/184.39; 440/88; 440/111

(58) Field of Search ..... 123/184.38, 184.39, 123/184.46, 73 A; 440/88, 111

(56) References Cited

U.S. PATENT DOCUMENTS

| | | | | |
|---|---|---|---|---|
| Re. 31,877 | | 5/1985 | Nomura . | |
| 4,319,657 | | 3/1982 | Nomura . | |
| 4,599,978 | * | 7/1986 | Kamata et al. | 123/73 A |
| 5,340,344 | * | 8/1994 | Mineo et al. | 440/88 |
| 5,820,426 | * | 10/1998 | Hale | 440/88 |
| 5,823,150 | * | 10/1998 | Konokawa | 123/73 A |
| 5,902,158 | * | 5/1999 | Nakase et al. | 440/88 |
| 5,902,161 | * | 5/1999 | Nakase | 440/88 |
| 5,906,524 | | 5/1999 | Ozawa et al. . | |
| 5,908,337 | * | 6/1999 | Mashiko | 440/88 |
| 5,967,861 | | 10/1999 | Ozawa et al. . | |

FOREIGN PATENT DOCUMENTS 8-74687 * 3/1996 (JP) .

* cited by examiner

*Primary Examiner*—Noah P. Kamen
(74) *Attorney, Agent, or Firm*—Knobbe, Martens, Olsen & Bear, LLP

(57) ABSTRACT

An air inlet device for an engine powering a water propulsion device of a watercraft, the watercraft having a hull defining an engine compartment in which the engine is positioned, is disclosed. The engine has a body defining at least one combustion chamber and an output shaft arranged to drive the water propulsion device. Air is supplied to the combustion chamber of the engine through the air inlet device. This device includes an intake pipe extending outwardly from the engine and an air box connected to the intake pipe. The air box has a cover having a top and a bottom and defining an interior air chamber, an air inlet provided near the top of the air box and a drain provided through the bottom of the air box. The intake pipe has a passage therethrough leading from the interior air chamber of the air box to said engine. The air box has a width at the top which is greater than a width at the bottom.

15 Claims, 8 Drawing Sheets

AIR INLET DEVICE FOR WATERCRAFT ENGINE

This application is a continuation-in-part of U.S. patent application Ser. No. 09/036,765, filed Mar. 9, 1998, now pending.

FIELD OF THE INVENTION

The present invention relates to an engine of the type used to power a watercraft. More particularly, the invention is an air inlet device for such an engine.

BACKGROUND OF THE INVENTION

Internal combustion engines are commonly used to power small watercraft such as personal watercraft. These watercraft include a hull which defines an engine compartment. The engine is positioned in the engine compartment. The output shaft of the engine is coupled to a water propulsion device of the watercraft, such as an impeller.

Air must be supplied to the engine from outside the hull for use in the combustion process. Typically, air flows through one or more ducts in the hull into the engine compartment, and then through an intake system of the engine to the combustion chamber(s) thereof.

The intake system commonly includes an air box defining an air chamber into which air from within the engine compartment is drawn. This air then flows through an intake pipe to the combustion chamber(s) of the engine. Generally, the air box is very large so that water separates from the air within the box. The box has a large flat bottom surface onto which the water is deposited and from which the water drains.

A problem is that the engine compartment of the watercraft is very small. As such, the air box can either not be as large as is necessary to properly permit separation of the water from the air, or is so large that it requires the watercraft to be larger or occupies much needed space for other components.

Another problem is that the water drains very slowly from the flat bottom of the air box. If the rate at which the water drains is too slow, the water level may rise to a high level, or the standing water may be redrawn into the air. In either case, water may enter the intake system and be drawn into the engine. This may result in corrosion of various engine parts and contribute to poor engine operating performance.

An improved air inlet device for an engine powering a watercraft is desired.

SUMMARY OF THE INVENTION

In accordance with the present invention there is provided an air inlet device for an engine. Preferably, the engine is of the type used to power a watercraft. The watercraft has a water propulsion device and a hull defining an engine compartment in which the engine is positioned.

The engine has a body defining at least one combustion chamber and has an output shaft arranged to drive the water propulsion device. Air is supplied to the combustion chamber of the engine through the air inlet device.

The air inlet device includes an intake pipe extending outwardly from the engine and an air box connected to a distal end of the intake pipe. The air box has a cover having a top and a bottom and defining an interior air chamber, an air inlet provided near the top of the air box and a drain provided through the bottom of the air box. The intake pipe has a passage therethrough leading from the interior air chamber of the air box to said engine.

As one aspect of the invention, the air box has a width at the top which is greater than a width at the bottom.

As another aspect of the invention, the distal end of the intake pipe has a top portion and a bottom portion. The bottom portion of the intake pipe is positioned closer to an adjacent side wall of the hull of the watercraft than the top portion.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is an air inlet device for an engine of the type utilized to power a small watercraft, such as a personal watercraft. The air inlet device is described in conjunction with an engine powering a personal watercraft since this is an application for which the device has particular utility. Those of skill in the art will appreciate that the device may have utility in a wide variety of other settings.

Figure 1:
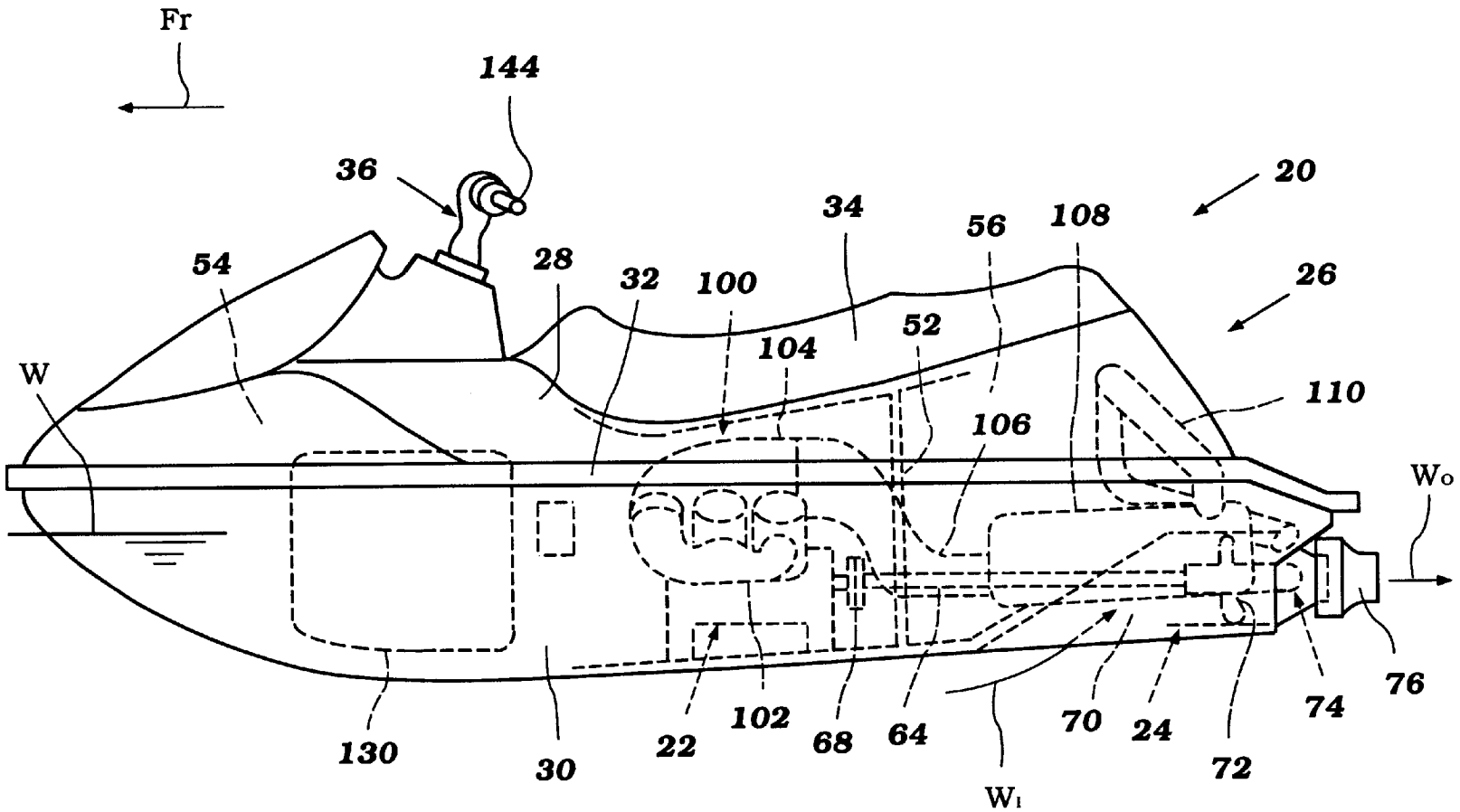
FIG. 1 is a side view of a personal watercraft of the type powered by an engine having an air intake device in accordance with a first embodiment of the present invention, the engine and other watercraft components positioned within a hull of the watercraft illustrated in phantom.
Figure 2:
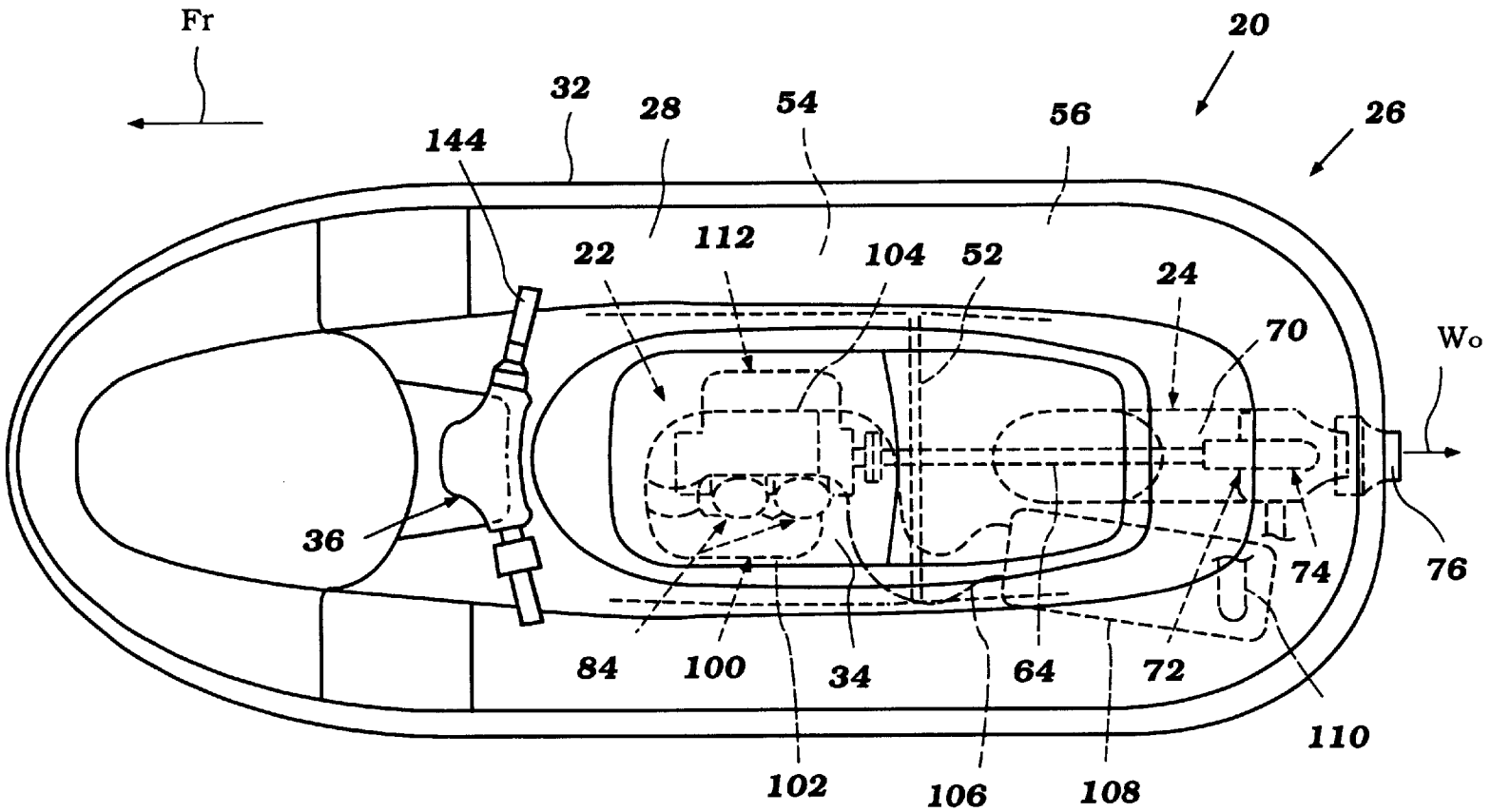
FIG. 2 is a top view of the watercraft illustrated in FIG. 1, with the engine and other watercraft components positioned within the watercraft illustrated in phantom.

FIGS. 1 and 2 illustrate a watercraft 20 having a watercraft body comprising a hull 26 having a top portion or deck 28 and a lower portion 30. A gunnel 32 defines the intersection of the lower portion 30 of the hull 26 and the deck 28. The watercraft 20 is suited for movement through a body of water W in a direction Fr (towards a front end of the watercraft).

A seat 34 is positioned on the top portion 28 of the hull 26. The seat 34 is preferably connected to a first removable deck member. A steering handle 36 is provided adjacent the seat 34 for use by a user in directing the watercraft 20.

Figure 3:
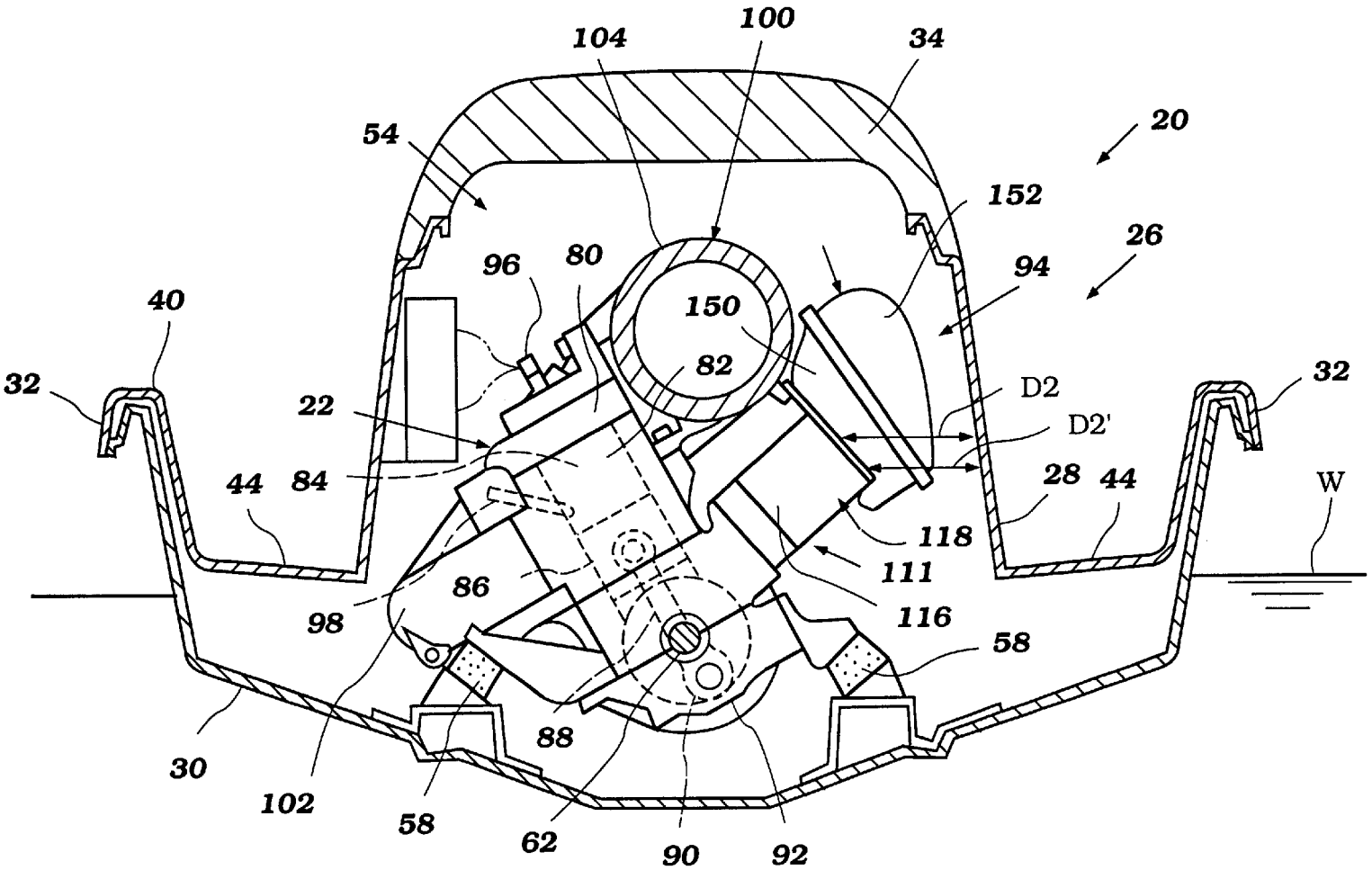
FIG. 3 is a cross-sectional end view of the watercraft illustrated in FIG. 1.

As best illustrated in FIG. 3, a bulwark 40 extends upwardly along each side of the watercraft 20. A foot step area 44 is defined between the seat 34 and the bulwark 40 on each side of the watercraft 20.

The top and bottom portions 28,30 of the hull 26, along with a bulkhead 52, define an engine compartment 54 and a pumping or propulsion unit compartment 56. The engine 22 is positioned in the engine compartment 54. As best illustrated in FIG. 3, the engine 22 is connected to the hull 26 with several engine mounts 58 connected to a bottom of the lower portion 30 of the hull 26. The engine 22 is preferably partially accessible through a maintenance opening accessible by removing a deck member on which the seat 34 is mounted.

The engine 22 has a crankshaft 62 (see FIG. 3) which is in driving relation with an impeller shaft 64 via a coupling 68 (see FIG. 1). The impeller shaft 64 rotationally drives a means for propelling water of a propulsion unit 24.

The propulsion unit 24 is preferably a water jet-propulsion unit including a propulsion passage 70 having an intake port which extends through the lower portion 30 of the hull 28. The means for propelling water, preferably an impeller 72 driven by the impeller shaft 64, is positioned in the passage 70 and draws water $W_I$ into the inlet. The impeller 72 drives the water through the passage 70 to a jet outlet 74 which discharges into a nozzle 78. The nozzle 78 is mounted for movement for directing water $W_O$ which is expelled from the rear or stem of the watercraft 20, whereby the direction of the propulsion force for the watercraft 20, and thus its direction, may be varied. Preferably, the position of the nozzle 78 is controlled with the steering handle 36.

The engine 22 preferably has two cylinders and operates on a two-cycle, crankcase compression principle. Of course, the engine 22 may have as few as one, or more than two, cylinders, as may be appreciated by one skilled in the art.

The engine 22 includes a cylinder head 80 mounted to a cylinder block 82 and cooperating therewith to define the two cylinders 84. A piston 86 is movably mounted in each cylinder 84 and is connected to the crankshaft 62 via a connecting rod 88, as is well known in the art. The piston 86 cooperates with the block 82 and head 80 to define a combustion chamber portion of each cylinder 84.

The crankshaft 62 is partially located within a crankcase chamber 90. This chamber 90 is defined by a crankcase cover 92 connected to an end of the cylinder block 82 of the engine 22 generally opposite the head 80.

Figure 4:
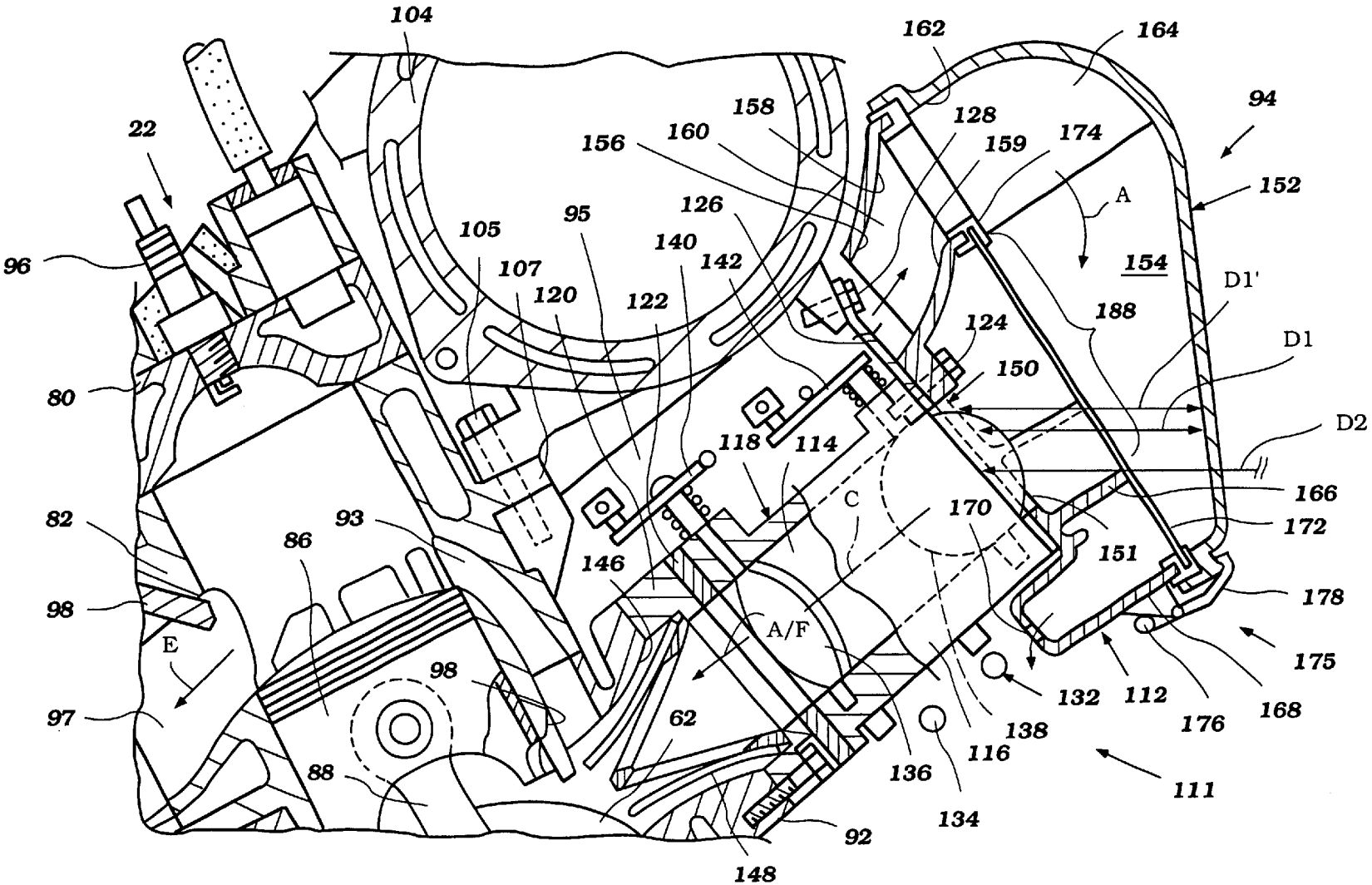
FIG. 4 is an enlarged cross-sectional view of the engine and a portion of the air intake device of the watercraft illustrated in FIG. 1.
Figure 5:
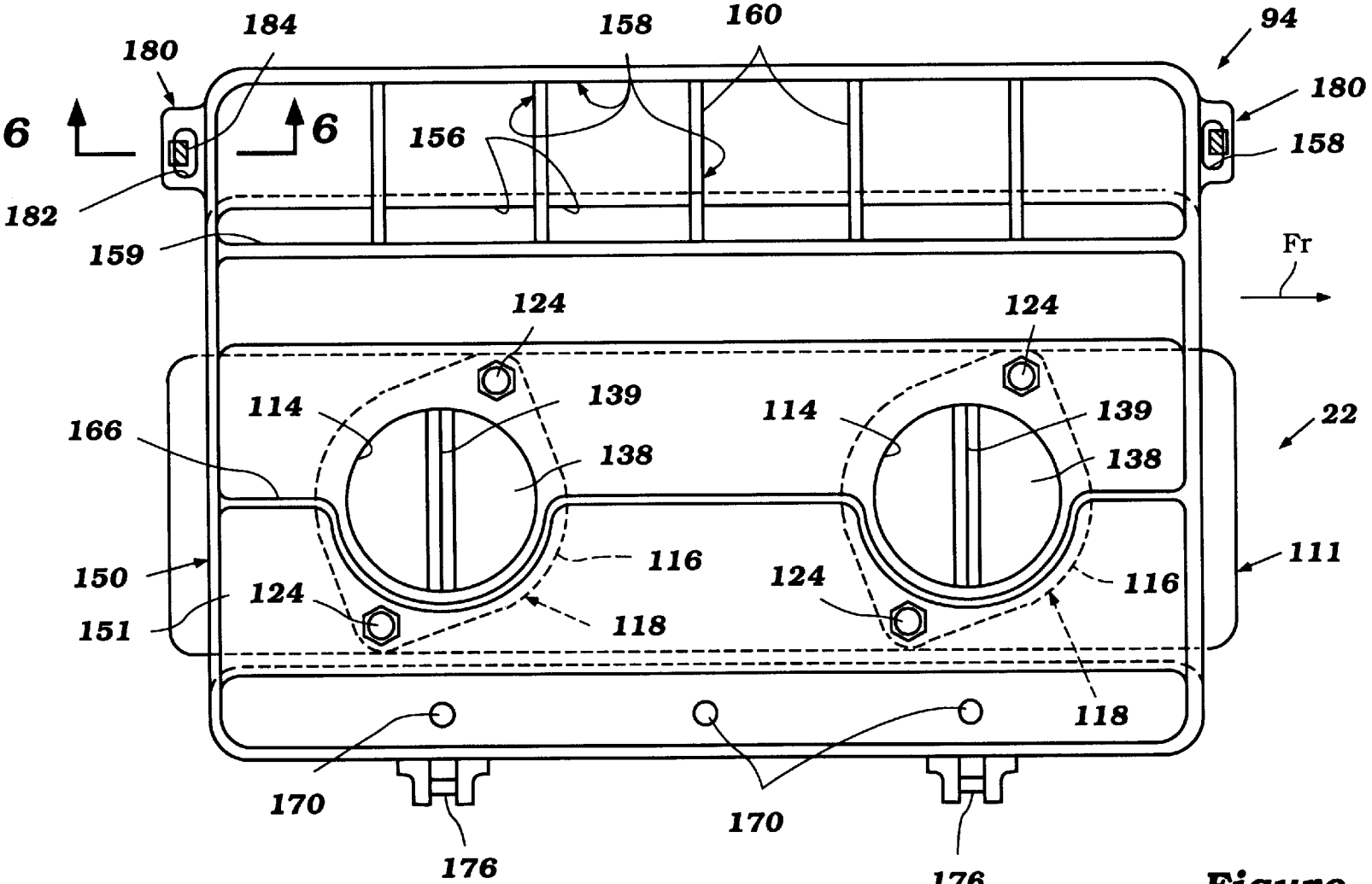
FIG. 5 is a top view of an air box of the air intake device illustrated in FIG. 4, with a cover of the air box removed.

Referring to FIGS. 3–5, the engine 22 includes means for providing air to each cylinder 84. Preferably, air is drawn into the engine compartment 54 through one or more air ducts (not shown). Air within the engine compartment 54 is supplied to the engine 22 through an air inlet device 94. The particular details of this air inlet device 94 are described below.

In this arrangement, an air and fuel mixture is delivered to the crankcase 90 of the engine 22. The crankcase 90 is divided so that a single chamber portion cooperates with one piston 86. As is well known in the art of two-cycle engines, the air and fuel mixture is partially compressed in the crankcase chamber 90 before being delivered through a scavenge passage 93 to the cylinder 84 above the piston 86. The piston 86 then further compresses the mixture and upon combustion, the piston 86 is driven downwardly, turning the crankshaft 62.

Preferably, combustion of the air and fuel mixture provided to each cylinder 84 is initiated with a spark plug 96 (see FIG. 3). The firing of each spark plug 96 is controlled by a suitable ignition system as well known to those of skill in the art.

Referring first to FIG. 4, the products of combustion (exhaust E) are routed from each cylinder 84 through an exhaust passage 97 leading therefrom through the cylinder block 82. The timing of the opening and closing of this passage is preferably controlled with an exhaust timing valve, such as a sliding-knife type valve 98.

The exhaust from each cylinder 84 flows through an exhaust system 100 to a discharge from the watercraft 20. Preferably, this exhaust system 100 includes an exhaust manifold 102 which is connected to the engine 22. The manifold 102 has a pair of branches defining passages corresponding to the two exhaust passages of the two cylinders 84. The branches of the manifold 102 merge into a single main branch.

The manifold 102 extends towards a front end of the engine 22 where it is connected to an expansion pipe 104, preferably through a flexible coupling. A catalyst may be provided in the exhaust system, such as in the expansion pipe 104. The expansion pipe 104 extends along the engine 22 towards the rear of the watercraft 20 to an upper exhaust pipe 106. As illustrated in FIG. 4, the expansion pipe 104 is preferably mounted to the cylinder block 82 by one or more fasteners 105 which are mounted to one or more mounting bosses 107 extending from the outside of the cylinder block.

The upper exhaust pipe 106 leads to a water lock 108. The water lock 108 prevents the back flow of water through the exhaust system 100 and may be of a variety of types known to those of skill in the art.

After passing through the water lock 108, the exhaust flows through a lower exhaust pipe 110 to a discharge from the watercraft 20. Preferably, the exhaust is discharged into the body of water in which the watercraft 20 is being operated.

As stated above, air is provided to the engine 22 through an air inlet device 94 including an intake or air box 112 and an intake guide member 111 extending between the air box 112 and engine 22, through which air from the box is guided to the engine. This guide member 111 includes a passage 114 defined by a body 116 of a carburetor 118 and a passage through a coupling plate 122 and intake manifold 120 leading into the crankcase chamber 90 of the engine 22.

As illustrated, the intake guide member 111 has an outer end spaced from the engine 22. This protruding end is defined by an end of the body 116 of the carburetor 118. The air box 112 is preferably connected to the carburetor 118 with one or more fasteners 124. A mounting plate 126 extending between the carburetor body 116 and air box 112 is connected to the cylinder block 82 with one or more fasteners 128, providing secure mounting of the air box 112 and carburetor 118 to the engine 22.

The end of the carburetor 118 opposite the air box 112 is mounted to the intake manifold 120 via the coupling plate 122. One or more fasteners then join the intake manifold 120 to the crankcase cover 92 portion of the engine 22.

As illustrated in FIG. 4, the axis along which the pistons 86 reciprocate is tilted from a vertical axis. At the same time, the air inlet device 94 extends from the engine 22 at an angle which is offset from vertical in the opposite direction of the axis along which the pistons 86 reciprocate. In this arrangement, a space 95 is defined between the air inlet device 94 and the body of the engine 22.

Fuel is provided to each cylinder 84 for combustion. Preferably, fuel is combined with the incoming air passing through the passage 114 of the carburetor 118. Fuel is drawn from a fuel tank 130 (see FIG. 1) positioned in the engine compartment 54 by a fuel pump (not shown) and delivered through a fuel delivery line 132 to a charge former, which in this case comprises the carburetor 118. Fuel which is delivered to the carburetor 118 but not delivered to the air flowing therethrough may be returned to the fuel tank 130 through a return line 134.

A throttle valve 136 and a choke valve 138 are movably mounted in the passage 114 for allowing the watercraft operator to control the rate of fuel and air delivery to the engine 22 for controlling the speed and power output of the engine via a throttle linkage and choke linkage of the carburetor 118. Each valve 136,138 preferably comprises a plate which is connected to a shaft 139 (see FIG. 5) which is rotatably mounted to the body 116 of the carburetor 118. Preferably, the throttle valve 136 is moveable with a throttle linkage 140 which is controlled by a throttle control 144 positioned on the steering handle 36 of the watercraft 20. The choke valve 138 is similarly controlled through a choke linkage 142.

The air and fuel mixture (labeled A/F in FIG. 4) selectively passes through an intake port 146 into the crankcase chamber 90 as controlled by a reed valve 148, as is known in the art.

Figure 6:
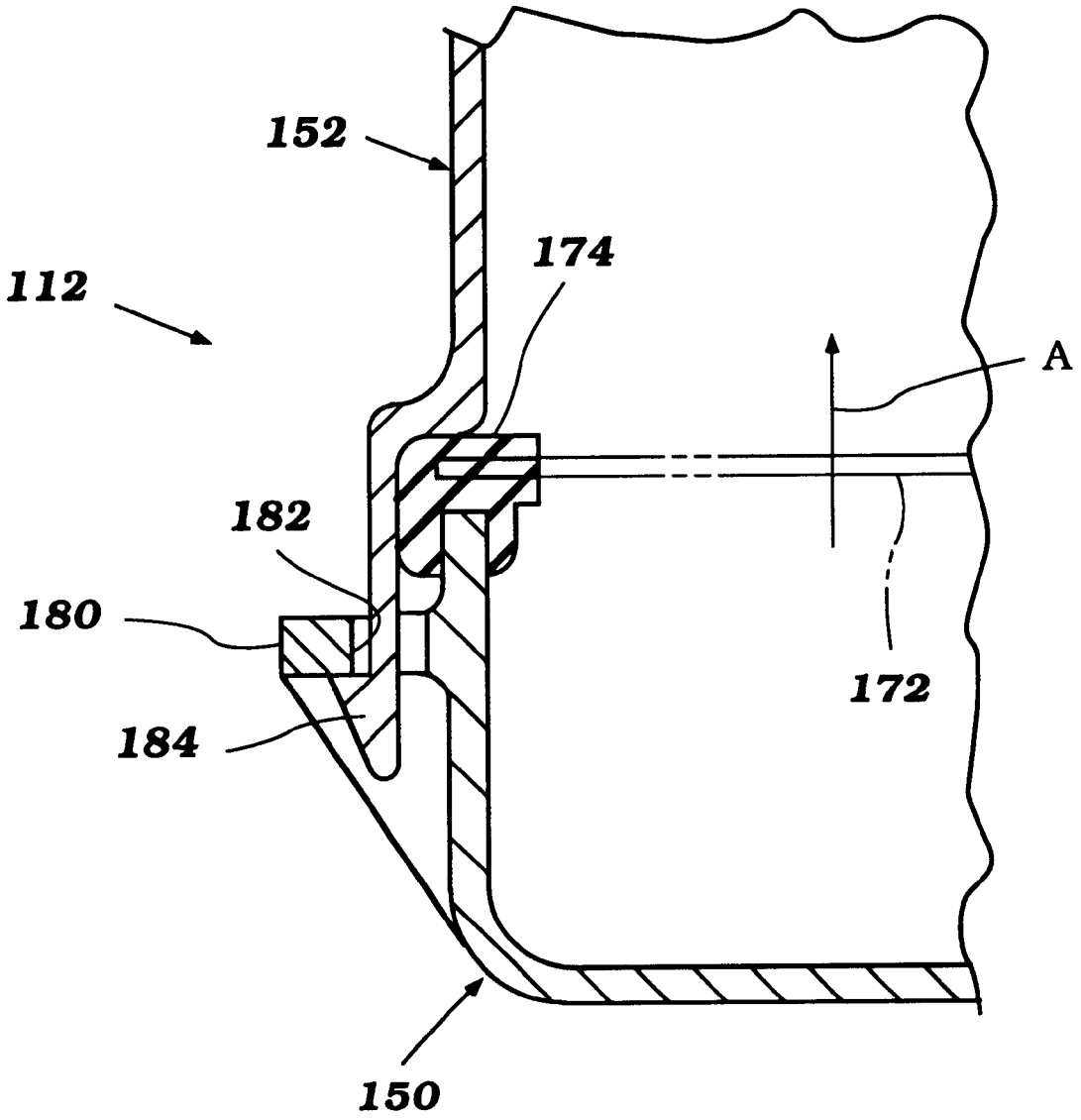
FIG. 6 is a cross-sectional end view of the air box illustrated in FIG. 5 (with the cover attached) taken in the direction of line 6—6 therein.

The construction of the air box 112 will now be described in more detail with reference to FIGS. 4–6. The box 112 has a lower portion or base 150. The base 150 has a relatively flat plate section 151 which is directly mounted to the end of the carburetor body 116 which extends away from the engine 22. Passages are provided through the plate section 151 of the base 150 corresponding to the passage 114 defined through each carburetor 118.

A cover 152 is selectively mounted to the base 150, and when so mounted the cover and base define an interior chamber 154.

A number of inlet air openings 156 are provided through the base 150. Preferably, the base 150 includes a guide wall 158 which is positioned outwardly of an upstanding wall portion 159 of the base 150. A number of ribs 161 extend between the guide wall 158 and the wall portion 159 of the base 150, creating a number of separate inlet passages 160 leading from the inlet air openings 156.

The cover 152 includes a guide wall 162 which extends from the guide wall 158 of the base 150. A number of ribs 164 are similarly provided on the guide wall 162 of the cover 152. In this fashion, the cover 152 defines extensions of the inlet passages 160 formed in the base 150. Each of these individual passages 160 has as its terminus the chamber 154.

A divider wall 166 extends upwardly from the plate section 151 of the base 150. This wall 166 is provided adjacent to the openings through the plate section 151 corresponding to the passages 114. The base 150 also includes an upstanding side wall 168 which is located generally opposite the guide wall 158 and spaced outwardly from the divider wall 166.

As illustrated, the lowest point within the air box 112 is provided between the side wall 168 and divider wall 166. At least one drain 170 is provided through the base 150 at this location. The drain 170 is a passage through the base 150 leading from the chamber 154. As best illustrated in FIG. 5, a number of drains 170 are provided along the width or length of the base 150.

A spark arrestor 172, in the form of a metallic net, is provided within the air box 112. Preferably, the spark arrestor 172 is positioned between the base 150 and cover 152. A seal 174 is provided at the outer edge of the arrestor 172 for sealing the space between the base 150 and cover 152.

As illustrated, the cover 152 is connected to the base 150 via a pair of hinges 175. In particular, a first pair of hinge members 176 extend from the side wall 168 of the base 150. Preferably, these members 176 include a mounting pin. A pair of mating pin-engaging hook hinge members 178 extend from the cover 152 and rotatably mount to the pin of the first member 176.

A lock mechanism is provided on the base 150 and cover 152 opposite the hinges 175. Referring to FIGS. 5 and 6, a pair of bosses 180 extend from the guide wall 158 of the base 150. A passage 182 is provided through each boss 180. A pair of locking pins 184 extend from the guide wall 162 of the cover 152. Each pin 184 is adapted to pass through the passage 182 of one of the bosses 180. The pins 184 are biased outwardly so that a catch portion 186 thereof is arranged to engage a bottom portion of the boss 180 after passing through the passage 182 thereof.

As illustrated in FIG. 4, the base 150 defines an air inlet opening 188 between the main portion 159 and divider wall 166.

Referring still to FIG. 4, a distance D1 is defined between the inside of the cover 152 of the air box 112 and the inlet opening through the base 150 at the outwardly extending end of the body 116 of the carburetor 118. As illustrated, this distance D1 is larger in the direction of the top of the air box 112 (i.e. towards the guide walls 158,162) than in the direction of the bottom of the air box 112 (i.e. towards the divider wall 166) (i.e. D1' is greater than D1). In this fashion, the space within the air box 112 becomes smaller moving in the direction of the inlet passages 160 towards the drain area.

Referring to FIGS. 3 and 4, a distance D2 is defined between the protruding end of the body 116 of the carburetor 118 and an adjacent side wall of the hull 26 of the watercraft 20. Referring to FIG. 4, it may be seen that the protruding end of the intake guide 111 (at the end of the carburetor 118) is angled since the intake extends at angle offset between vertical and horizontal from the engine 22. Thus, this end of the intake guide 111 has a top portion and a bottom portion which are positioned at different distances from the adjacent side wall of the hull 26. The distance D2 is largest towards a top portion of the intake guide member 111 (i.e. intake pipe or carburetor) and smallest towards the bottom end (i.e. D2 is greater than D2').

In this embodiment, water is separated from the air in the air box 112. This water is routed to the bottom of the air box 112 where it drains quickly therefrom. What water does collect has a small surface area due to the tapered configuration of the box 112 with its small bottom surface. In addition, the air box 112 is sized so that it is small and occupies relatively little space in the engine compartment 54.

Though not illustrated, the engine 22 may include a flywheel connected to one end of the crankshaft 62 and having a number of magnets thereon for use in a pulsar-coil arrangement for generating firing signals for the ignition system. In addition, the ignition system may include a battery for use in providing power to an electric starter and other electrical engine features. In addition, a number of teeth may be mounted on the periphery of the flywheel for use in starting the engine 22 with a starter motor (not illustrated).

The engine 22 includes a lubricating system for providing lubricating oil to the various moving parts thereof. Preferably, the lubricating system includes an oil tank or reservoir (not shown) from which lubricating oil is delivered to and circulated throughout the engine, as is well known to those skilled in the art. The engine 22 may also be provided with a suitable cooling system as known to those of skill in the art.

Figure 7:
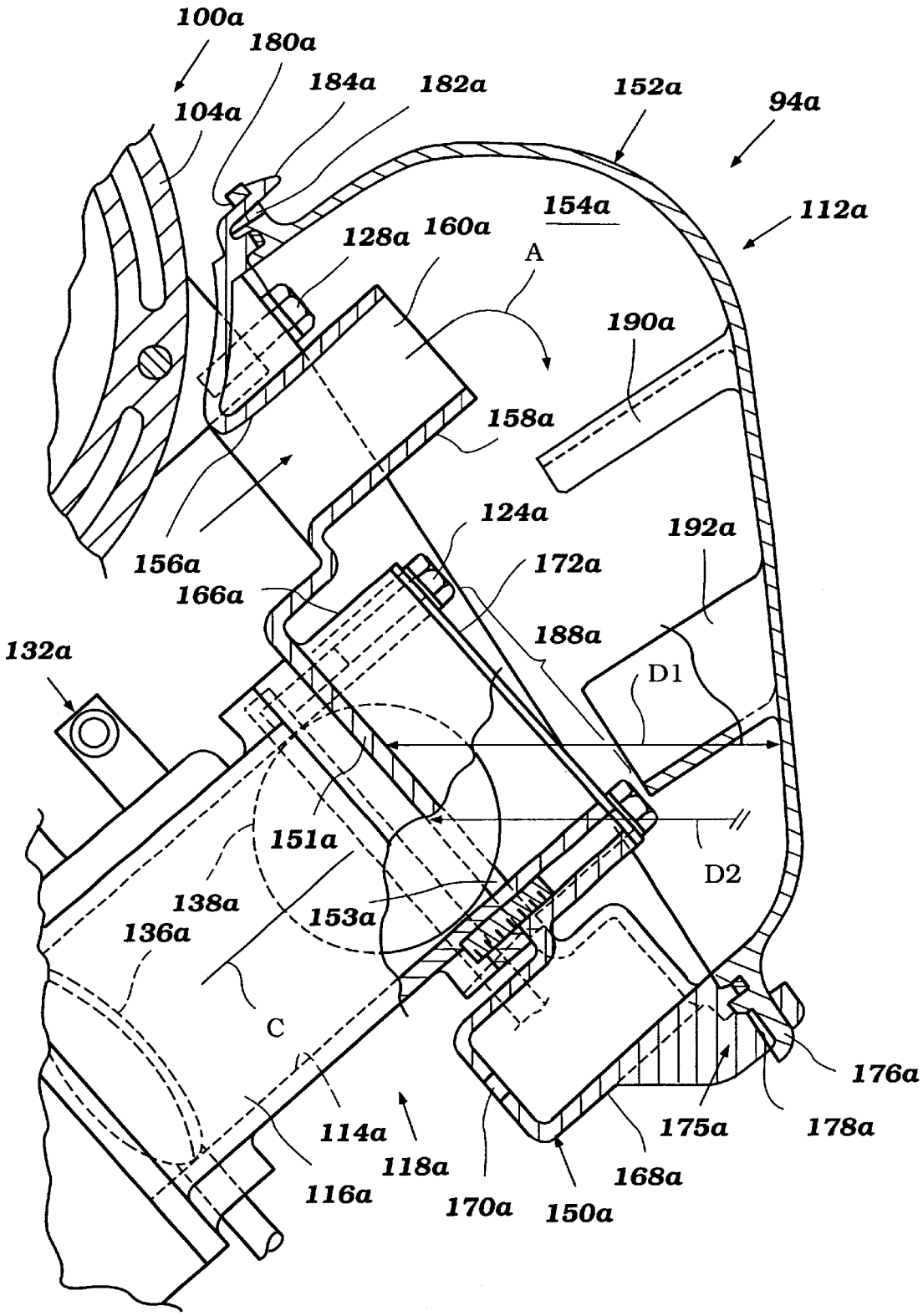
FIG. 7 is a cross-sectional view of an air intake device in accordance with a second embodiment of the present invention.
Figure 8:
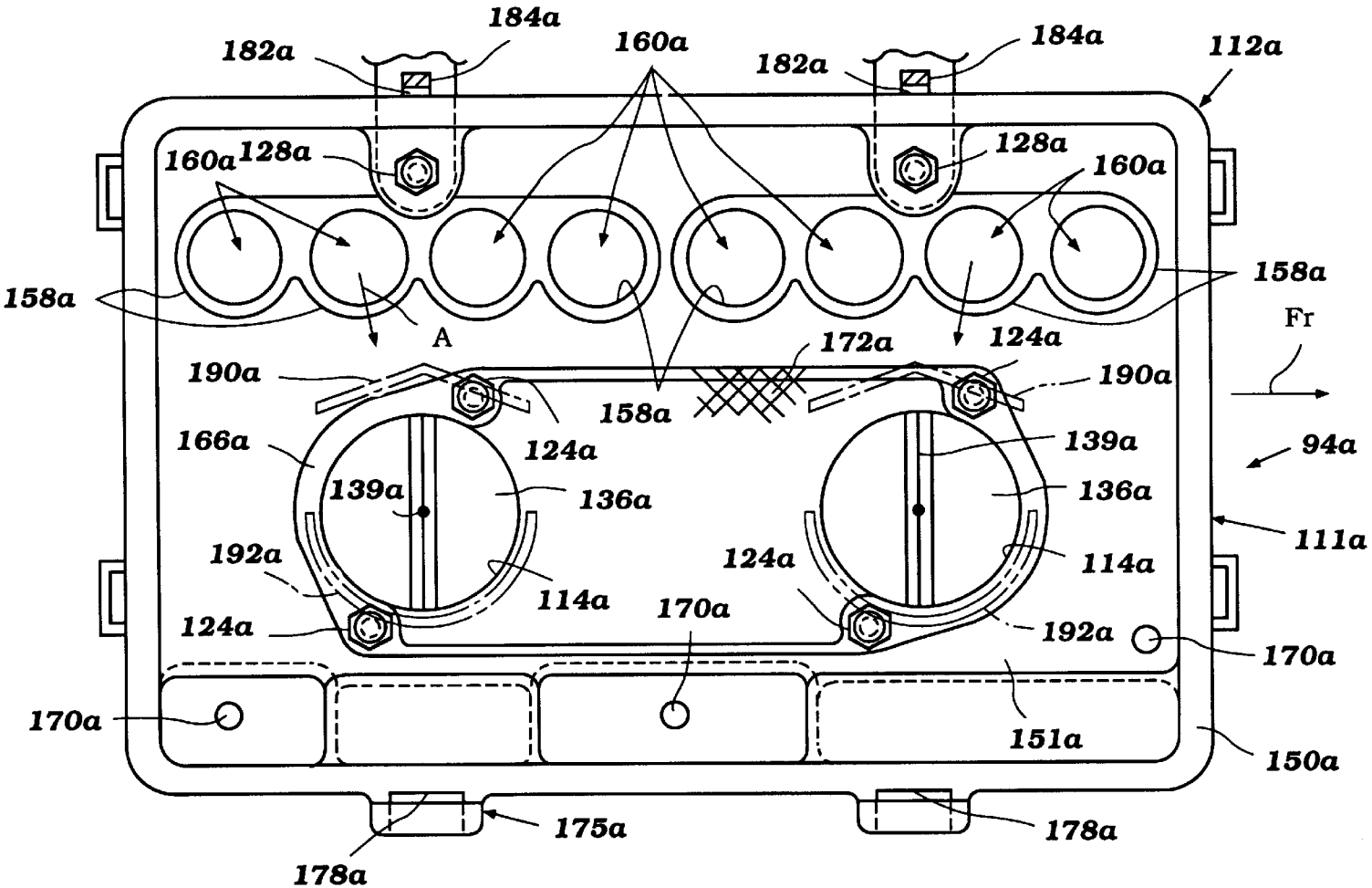
FIG. 8 is top view of an air box of the air intake device illustrated in FIG. 7, with a cover of the air box removed.

A second embodiment of an air inlet device in accordance with the present invention is illustrated in FIGS. 7–8. In the description and illustration of this embodiment, like reference numerals will be used for like or similar parts to those of the first embodiment, except that an "a" designator has been added to all of the reference numerals of this embodiment.

In this embodiment, a base 150*a* of the air box 112*a* is again connected to the carburetor 118*a,* which is part of an intake guide member 111*a* (see FIG. 8) which extends at an angle from the engine 22*a*.

A guide wall 158*a* extends upwardly from a generally flat plate section 151*a* of the base 150*a*. The guide wall 158*a* is cylindrical, defining an inlet opening 156*a* leading to an inlet passage 160*a*. The guide wall 158*a* terminates within an interior chamber 154*a* defined by a cover 152*a* connected to the base 150*a*.

A divider wall 166*a* extends upwardly from the plate section 151*a* of the base 150*a*. This wall 166*a* defines an oblong area 188*a* around openings 153*a* in the base 150*a* leading to the passage 114*a* through each carburetor 118*a*. The screen 172*a* is preferably mounted at the top of this wall 166*a* over this area.

A number of front deflectors 190*a* extend into the chamber 154*a* from the cover 152*a*. Each deflector 190*a* is preferably "V"-shaped, with the point of the "V" facing towards the inlet passages 160*a*. Each deflector 190*a* is preferably positioned between an opening 153*a* and the air inlet passages 160*a* as defined by the guide walls 158*a*. As illustrated, each deflector 190*a* extends downwardly towards a front portion of the divider wall 166*a* and cooperates therewith to define a small passage therebetween.

A second deflector 192*a* is provided corresponding to each passage 153*a*. These deflectors 192*a* are semicircular in shape and also extend downwardly from the cover 152*a* into the chamber 154*a*. These deflectors 192*a* are positioned near the rear portion of the divider wall 166*a*.

As illustrated, the front and rear deflectors 190*a*, 192*a* and divider wall 166*a* cooperate to define an air path from the inlet passages 160*a* to the passages 153*a* through the base 150*a* which are generally indirect, reducing the probability of water entering the engine 22*a*.

Water which is trapped in the air box 112*a* is preferably drained therefrom by a number of drains 170*a*. Again, the drains 170*a* are primarily positioned in the lowest portion of the box 112*a* between a side wall 168*a* of the base 150*a* and the divider wall 166*a*. Additional drains may be provided as needed.

The cover 152*a* is again connected to the base 150*a* with a pair of hinges 175*a*. In this embodiment, hook portions of the hinges 178*a* are positioned on the base 150*a* (instead of the cover as in the first embodiment), while mating pin portions 176*a* are provided on the cover 152*a*. Again, the hook portions 178*a* wrap around and engage the pin portions 176*a*, providing a rotatable mounting at one side of the air box 112*a* between the base 150*a* and cover 152*a*.

At the opposite side, a pair of bosses 180*a* having passages 182*a* therethrough extend from the cover 152*a*. A pair of mating pins 184*a* extend upwardly from the base 150*a* for selective passage through the passages 182*a* for locking the cover and base together at this side of the air box 112*a*.

In this embodiment, like the last, the chamber 154*a* defined in the air box 112*a* has a width D1 which is larger at the top of the air box than at the bottom. In addition, the distance D2 between the protruding end of the intake guide member 111*a* and the adjacent side wall of the hull 26*a* of the watercraft 20*a* is largest near a top portion of the guide member 111*a* and smaller near the bottom portion thereof.

Those of skill in the art will appreciate that the specific configuration of the air box may vary from those described above and still fall within the scope of the invention. In addition, while the fuel is added to the air with a carburetor, those of skill in the art will appreciate that the fuel may be added with a fuel injector.

Of course, the foregoing description is that of preferred embodiments of the invention, and various changes and modifications may be made without departing from the spirit and scope of the invention, as defined by the appended claims.

What is claimed is:

1. An air inlet device for an engine powering a water propulsion device of a watercraft, said watercraft having a hull defining an engine compartment in which said engine is positioned, said engine having a body defining at least one combustion chamber and having an output shaft arranged to drive said water propulsion device, said engine including said air inlet device through which air is supplied to said combustion chamber, said air inlet device including an intake pipe extending outwardly from said engine to a distal end and an air box connected to said distal end, said air box having a top and a bottom and defining an interior air chamber, an air inlet provided near said top of said air box and opening into said interior air chamber near a top of said chamber, and a drain provided through said bottom of said air box, said intake pipe having a passage therethrough leading from said interior air chamber of said air box to said engine, said air box having a width at said top which is greater than a width at said bottom.

2. The air inlet device in accordance with claim 1, wherein said intake pipe at least partially comprises a carburetor.

3. The air inlet device in accordance with claim 1, wherein said air box includes a cover part connected to a base part.

4. The air inlet device in accordance with claim 3, wherein said inlet is provided through said base part.

5. The air inlet device in accordance with claim 1, wherein said combustion chamber is defined by a cylinder of said engine and a piston mounted in said cylinder and reciprocating along a line offset to one side of vertical, and wherein said intake pipe extends from said engine along a line offset from vertical to an opposite side of said line along which said cylinder extends.

6. The air inlet device in accordance with claim 5, where a space is defined between said intake pipe and said body of said engine, said inlet facing into said space.

7. The air inlet device in accordance with claim 1, wherein said inlet is located over said distal end of said intake pipe.

8. The air inlet device in accordance with claim 1, wherein said air inlet is arranged to direct air flowing into said interior air chamber away from said intake pipe.

9. An air inlet device for an engine powering a water propulsion device of a watercraft, said watercraft having a hull defining an engine compartment in which said engine is positioned, said engine having a body defining at least one combustion chamber and having an output shaft arranged to drive said water propulsion device, said engine including said air inlet device through which air is supplied to said combustion chamber, said air inlet device including an intake guide member extending from said engine to a distal end located towards a wall of said hull, said intake guide member having a passage therethrough leading to said engine and an air box positioned at said distal end, said air box defining an interior air chamber and having an air inlet located near a top of said air box, said air inlet opening into said interior air chamber near a top of said chamber, said distal end of said intake guide member having a top portion and a bottom portion, said bottom portion positioned closer to said wall of said hull than said top portion.

10. The air inlet device in accordance with claim 9, wherein a portion of said intake guide member is defined by a carburetor.

11. The air inlet device in accordance with claim 9, wherein a top portion of said chamber has a width which is greater than a bottom portion of said chamber.

12. The air inlet device in accordance with claim 11, wherein at least one drain is provided from said air box at a bottom thereof.

13. The air inlet device in accordance with claim 10, wherein said distal end of said intake guide member is defined by said carburetor.

14. The air inlet device in accordance with claim 9, wherein said inlet is located over said distal end of said intake guide member.

15. The air inlet device in accordance with claim 9, wherein said air inlet is arranged to direct air flowing into said interior air chamber away from said intake guide member.

* * * * *